US005686686A

United States Patent [19]

Woodall, Jr. et al.

[11] Patent Number: 5,686,686

[45] Date of Patent: Nov. 11, 1997

[54] HAND EMPLACED UNDERWATER MINE PENETRATION SYSTEM

[75] Inventors: Robert C. Woodall, Jr., Pasadena, Md.; Felipe A. Garcia, Panama City, Fla.

[73] Assignee: The United States of America as represented by the Secretary of the Navy, Washington, D.C.

[21] Appl. No.: 605,298

[22] Filed: Jan. 25, 1996

[51] Int. Cl.[6] ..... F41B 15/00; F42B 30/00

[52] U.S. Cl. ..... 89/1.13; 89/1.11; 102/403

[58] Field of Search ..... 89/1.1, 1.11, 1.13, 89/1.3, 1.35; 102/402, 403, 231

[56] References Cited

U.S. PATENT DOCUMENTS

| | | | |
|---|---|---|---|
| 2,340,047 | 1/1944 | Dunn | 89/1.3 |
| 2,597,031 | 5/1952 | Posey | 89/1.35 |
| 3,673,916 | 7/1972 | Wittholz | 89/1.816 |
| 3,929,055 | 12/1975 | Lewis | 89/1.13 |
| 3,951,037 | 4/1976 | Bornand | 89/1.3 |
| 4,232,605 | 11/1980 | Lair | 89/1.1 |
| 5,042,387 | 8/1991 | Backstein | 89/1.13 |
| 5,345,853 | 9/1994 | Crepin et al. | 89/1.35 |
| 5,576,510 | 11/1996 | Rudenauer | 102/231 |

*Primary Examiner*—Michael J. Carone
*Assistant Examiner*—Theresa M. Wesson
*Attorney, Agent, or Firm*—Harvey A. Gilbert; William C. Townsend

[57] ABSTRACT

A hand emplaced underwater mine penetration system includes a launching assembly and a munition assembly. The launching assembly includes a firing device which receives a magnetic or acoustic signal from a standoff signal generator, and a launch tube having a forward open end, an opposite rear end connected to the firing device and a bore extending between the ends. The munition assembly is adapted for insertion within and firing from the bore of the launch tube of the launching assembly and includes a cartridge having explosive elements therein and a fuze disposed at a forward end of the cartridge and adapted to detonate and explode the explosive elements in the cartridge upon impact with an underwater mine.

12 Claims, 3 Drawing Sheets

HAND EMPLACED UNDERWATER MINE PENETRATION SYSTEM

BACKGROUND OF THE INVENTION

1. Field of the Invention

The present invention generally relates to devices for detonating underwater mines and, more particularly, is concerned with a hand emplaced underwater mine penetration system.

2. Description of the Prior Art

Explosive mines are used in warfare and may be planted on land or underwater. Devices have been developed over the years to detonate such mines so as to avoid accidental or unintentional set off. Common methods of detonation of underwater mines require bulk charges of explosive to be placed in close proximity to mines. This is a dangerous operation in which divers or other delivery systems may accidentally set off the bulk explosive or mine prematurely. Such an occurrence would result in death or serious injury. A major problem with this method is the close proximity to the mine to which the swimmer or other delivery systems must maneuver in order to complete the mission.

Consequently, a need still exists for a device or system which overcomes this aforementioned problem in the prior art without introducing any new problems in place thereof.

SUMMARY OF THE INVENTION

The present invention provides a hand emplaced underwater mine penetration system designed to satisfy the aforementioned need. The hand emplaced underwater mine penetration system of the present invention can be used to render ineffective underwater mines without the need for swimmers to place explosives directly upon any part of a particular mine. This advantage of the system is achieved by virtue of the fact that the system can be located a standoff distance from the mine and is remotely fired so as to avoid contact between swimmers and the mine.

Accordingly, the present invention is directed to a hand emplaced underwater mine penetration system which comprises: (a) a launching assembly; and (b) a munition assembly. The launching assembly includes a firing device which receives a magnetic or acoustic signal from a standoff signal generator, a launch tube having a forward open end, an opposite rear end connected to the firing device and a bore extending between the ends, and means for anchoring the launch tube. The munition assembly is for insertion within and firing from the bore of the launch tube of the launching assembly and includes a cartridge having explosive elements therein and a fuze for detonating the explosive elements in the cartridge upon impact with an underwater mine.

More particularly, the firing device of the launching assembly has a safety element to prevent accidental set off thereof. The launch tube of the launching assembly is substantially cylindrical in shape and has an internal rifling insert surface and an external containment tube. The anchoring means of the launching assembly is an external pivotable shovel attached to the underside of the launch tube and a pair of external alligator clasps attached to a side of the launch tube and extending thereabove. The cartridge of the munition assembly has a projectile body with a pair of spaced apart opposite rear and forward cavities, a propellant located within the rear cavity and an explosive warhead located within the forward cavity. The fuze of the munition assembly has a housing with a pair of opposite forward and rear ends with the rear end interfitting with the forward cavity of the projectile body of the cartridge, a nose cone mounted to and extending forwardly from the forward end of the housing, a firing pin enclosed in the nose cone and mounted to the forward end of the housing, a booster charge located at the rear end of the housing adjacent to the explosive warhead in the forward cavity of the projectile body and a detonator disposed in the housing and being located between the firing pin and the booster charge such that the explosive warhead is exploded by detonation of the booster charge as a result of actuation of the detonator by impact with the firing pin.

Furthermore, the detonator is disposed within a chamber formed by the housing of the fuze. The detonator is substantially cylindrical in shape and has a length substantially similar to the diameter of the chamber. The detonator is further normally biased to an unarmed condition set at a predetermined acute angle relative to the firing pin and is movable from the unarmed condition to an armed condition in which the detonator is in alignment with the firing pin and the forward end of the booster charge in response to imposition of a set back force thereon created by the firing of the propellant and the acceleration and resultant spinning of the munition assembly.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
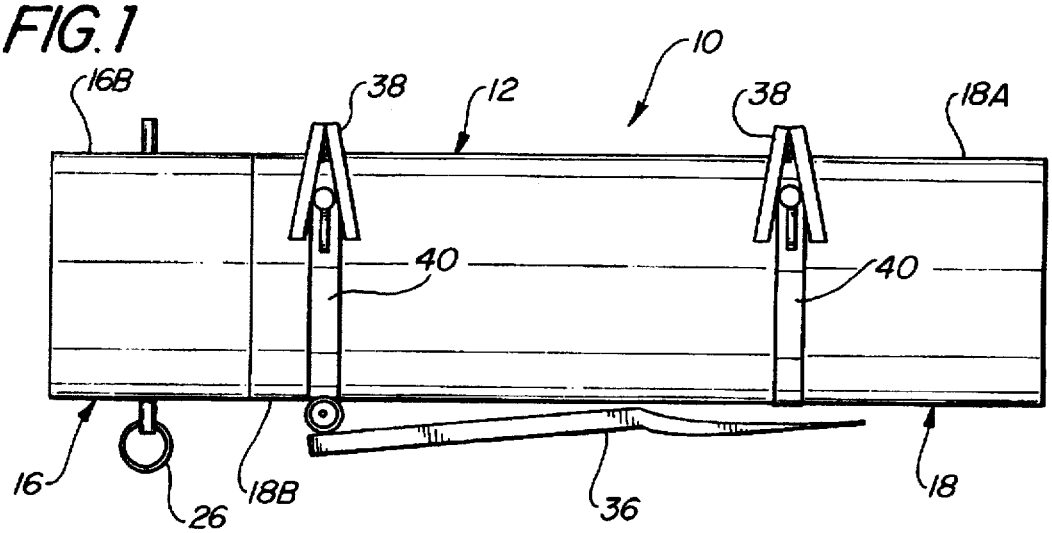
FIG. 1 is a side elevational view of a hand emplaced underwater mine penetration system of the present invention.
Figure 2:
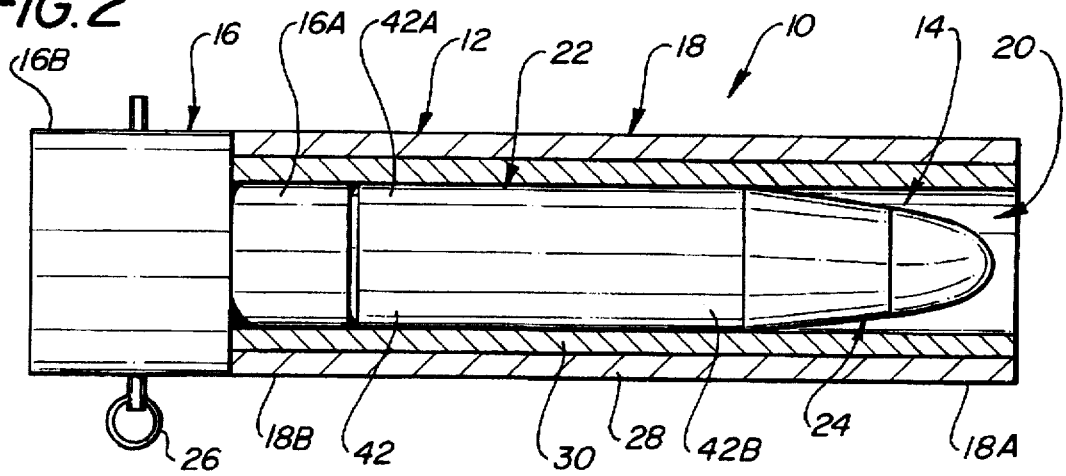
FIG. 2 is a partially sectioned view of the system as shown in FIG. 1 with the munition assembly inserted within the launching assembly.
Figure 3:
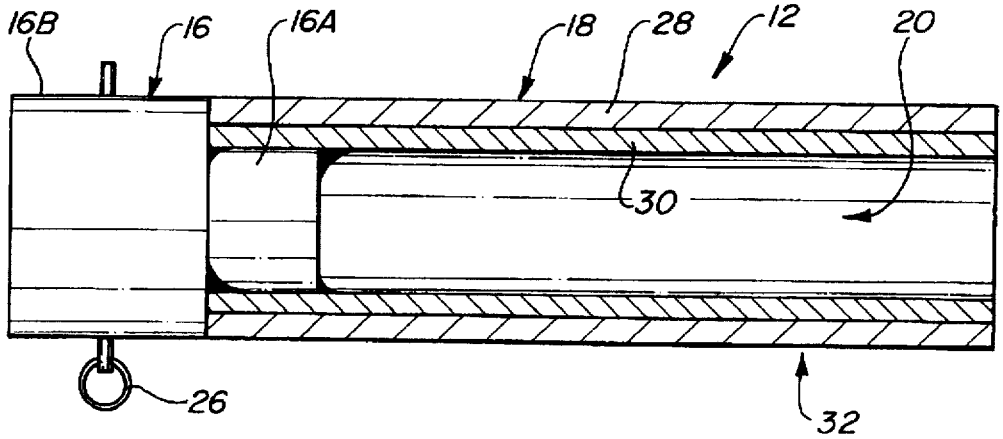
FIG. 3 is the same view of the system as shown in FIG. 2 but without the munition assembly.
Figure 4:
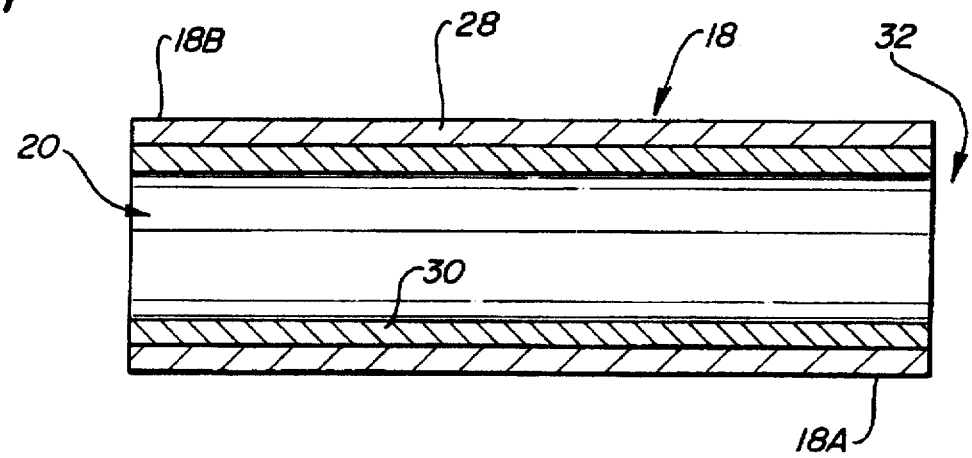
FIG. 4 is a longitudinally sectioned view of the launch tube of the launching assembly of the system.
Figure 5:
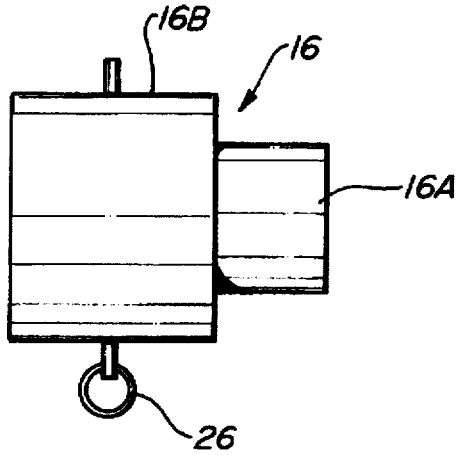
FIG. 5 is a side elevational view of the firing device of the launching assembly of the system.

Referring to the drawings and particularly to FIGS. 1 and 2, there is illustrated a hand emplaced underwater mine penetration system, generally designated 10, of the present invention for rendering ineffective underwater mines from a standoff position without the need for swimmers to place explosives directly upon any part of a mine. Basically, the hand emplaced underwater mine penetration system 10 includes a launching assembly 12 and a munition assembly 14 to be received within and fired from the launching assembly 12. With respect to its overall size, the system 10 preferably has a diameter similar to that of a flare gun and a length half of that of an ordinary police baton and is comprised of materials which are strong enough to withstand high velocity transport underwater.

More particularly, the launching assembly 12 of the system 10 includes a firing device 16 and a launch tube 18. The launch tube 18 of the launching assembly 12 has a forward open end 18A, an opposite rear end 18B which receives and is connected to the firing device 16, and an axial or longitudinal bore 20 extending between the forward and rear ends 18A, 18B. The munition assembly 14 of the system 10 is adapted for insertion within the longitudinal bore 20 of the launch tube 18 to a rest position therein, as shown in FIG. 2, adjacent to the firing device 16. The munition assembly 14 is launched from its rest position in the bore 20 of the launch tube 18 upon activation of the firing device 16 by receipt of a predetermined signal. The munition assembly includes a cartridge 22 having explosive elements therein and a fuze 24 for detonating the explosive elements in the cartridge 22 upon impact with an underwater mine. The firing device 16 of the launching system 12 is adapted to receive a magnetic signal or acoustic signal from a conventional standoff signal generator (not shown), decode the signal and then ignite some of the explosive elements of the cartridge 22. The explosive elements, which will be described hereinafter, contain chemical energy stored in solid form and are explosive or pyrophoric in nature in that they will cause a detonation or burning reaction upon impact with its target or otherwise upon ignition.

Referring now to FIGS. 1 to 3 and 5, the firing device 16 of the launching assembly 12 has front and back portions 16A, 16B with each of the portions 16A, 16B being substantially cylindrical in shape. The back portion 16B has a diameter substantially similar to that of the launch tube 18 while the front portion 16A has a diameter substantially smaller than that of the back portion 16B so that the front portion 16A inserts within the longitudinal bore 20 of the launch tube 18 with the second end 18B of the launch tube 18 in flush contact with the back portion 16B of the firing device 16. The firing device 16 further has a safety pin 26 passing therethrough to prevent accidental set off of the firing device 16. The safety pin 26 must be physically removed by the user before the system 10 can function.

Referring now to FIGS. 1 to 5, the launch tube 18 of the launching assembly 12 is preferably cylindrical in shape and includes an external containment tube 28 and an internal rifling insert surface 30 mounted within the container tube 28 to form a shell 32 defining the longituduinal bore 20. The internal rifling insert surface 30 is preferably made substantially of any suitable rigid material. The external containment tube 28 is preferably made substantially of any suitable plastic material. The shell 32 has a diameter substantially similar in size to the back portion 16B of the firing device 16 and thus is greater in diameter than the front portion 16A thereof. The bore 20 of the launch tube 18 has a diameter only slightly greater than the diameter of the front portion 16A of the firing device 16 so that the front portion 16A snugly interfits therewith. The launch tube 18 has a length substantially greater than that of the firing device 16 to provide sufficient space within the longitudinal bore 20 for receiving the munition assembly 14 therein.

The launching assembly 12 of the system 10 further includes an anchoring means 34 for supporting the launch tube 18. The anchoring means 34 can take any suitable form, one of which being an external pivotable shovel 36 attached to the underside of the launch tube 18 and a pair of external alligator clasps 38 attached to a side of the launch tube 18 and extending thereabove. The shovel 36 when inserted into the ground anchors and stabilizes the system 10 for facilitating the aiming and launching of the munition assembly 14 toward an underwater bottom mine. Each alligator clasp 38 is attached to a strap 40 wrapped around the shell 32 of the launch tube 18 and each is used to attach the system 10 to a standing structure such as an anchor of a mine or a mooring line of a floating mine for directing the line of fire of the system 10 toward the underwater mine. The system 10 further may have an attachment (not shown) of any suitable means to link the system 10 to the belt of a swimmer. The launching assembly 12 is also disposable after a single use.

Figure 6:
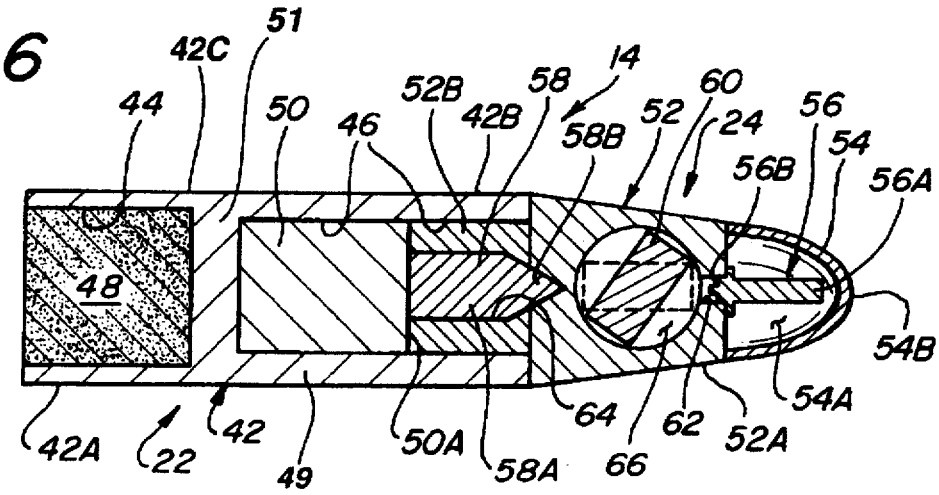
FIG. 6 is a longitudinally sectioned view of the munition assembly of the system.

Referring now to FIGS. 2 and 6, the cartridge 22 of the munition assembly 14 includes a projectile body 42 having a pair of separate rear and forward cavities 44, 46 formed by opposite rear and forward portions 42A, 42B of the projectile body 42. The cartridge 22 also includes a propellant 48 located within the rear cavity 44 and an explosive warhead 50 located within the forward cavity 46. The rear and forward cavities 44, 46 of the projectile body 42 are separated from one another by an intermediate portion 42C of the body 42 disposed between the rear and forward portions 42A, 42B. The rear and forward portions 42A, 42B of the body 42 define an outer annular wall 49 surrounding and forming the rear and forward cavities 44, 46. The intermediate portion 42C of the body 42 defines an inner transverse wall 51 that is spaced from opposite ends of the outer annular wall 49 and extends transversely across and is rigidly attached to the annular circumferential wall 49. The inner transverse wall 51 is disposed between and separates the rear and forward cavities 44, 46 in the projectile body 42 and thereby separates the propellant 48 in the rear cavity 44 from the explosive warhead 50 in the forward cavity 46 so that ignition of the propellant 48 in the rear cavity 44, that fires the cartridge 22 from the launch tube 18, prevents premature detonation of the explosive warhead 50 in the forward cavity 46. The outer annular wall 49 of the projectile body 42 preferably has a substantially cylindrical shape with a diameter substantially similar to that of the front portion 16A of the firing device 16 and slightly less than that of the longitudinal bore 20 for facilitating insertion of the cartridge 22 within the longitudinal bore 20 of the launch tube 18. The rear cavity 44 has a greater diameter than that of the forward cavity 46 while the forward cavity 46 has a greater axial length than that of the rear cavity 44. The propellant 48 takes up the entire volume of the rear cavity 44. The warhead 50 takes up more than half of the volume of the forward cavity 46 but leaves more than a third of the volume of the forward cavity 46 empty at the forward end thereof for insertion therein of a portion of the fuze 24 of the munition assembly 14. The rear and forward cavities 44, 46 and the propellant 48 and warhead 50 preferably are all cylindrical in shape.

The fuze 24 of the munition assembly 14, which is adapted for detonating the warhead 50 of the cartridge 22 upon impact with an underwater mine, includes a housing 52 having a pair of opposite forward and rear ends 52A, 52B. The rear end 52B of the housing 52 interfits within and occupies the remainder of the forward cavity 46 of the projectile body 42 of the cartridge 22 left unoccupied by the explosive warhead 50 such that the rear end 52B of the housing 52 is disposed adjacent to and in contact with the front surface 50A of the explosive warhead 50. Either mounted to or disposed in the housing 52 thereof, the fuze 24 also includes a hollow cavitating nose cone 54, a firing pin 56, a booster charge 58 and a detonator 60.

The cavitating nose cone 54 of the fuze 24 is mounted to and extends forwardly from the forward end 52A of the housing 52. When the munition assembly 14 is fired and launched through the water, the cavitating nose cone 54 creates a void in the water through which the munition assembly 14 passes to prevent premature detonation of the munition assembly 14. The shape and velocity of the cavitating nose cone 54 is important in creating this void. The spinning action of the munition assembly 14 created by the rifling surface in the launch tube 18 provides stability of the munition assembly 14 as it moves through the water.

The firing pin 56 of the fuze 24 is enclosed in the hollow nose cone 54 and mounted to the forward end 52A of the housing 52. The firing pin 56 has a pair of opposite forward and rear ends 56A, 56B and is disposed within a chamber 54A formed by the hollow nose cone 54. The forward end 56A of the firing pin 56 extends forwardly into the empty space of the chamber 54A but terminates and is spaced inwardly from the tip 54B of the nose cone 54. The rear end 56B of the firing pin 56 is attached to the forward end 52A of the housing 52 of the fuze 24 by being mounted and inserted into aperture 62 through the forward end 52A of the housing 52.

The booster charge 58 of the fuze 24 is located within a rearward bore 64 open at and defined in the rear end 52B of the housing 52 adjacent to the explosive warhead 50. The booster charge 58 thus has a rear end 58A adjacent to the warhead 50 and a forward end 58B formed in the shape of conical tip spaced rearwardly from but located adjacent to the detonator 60. The booster charge 58 is not as sensitive to a given activating force as is the detonator 60 and so is meant to be a medium for transfer of a plane wave of detonating energy from the detonator 60 to the explosive warhead 50. Therefore, the booster charge 58 serves as an intermediate charge to increase the explosive output from the detonator 60 to cause the warhead 50 to explode. The booster charge 58 is necessary here because the energy output from the detonator 60 is not great enough to cause the warhead 50 to explode on its own. Therefore, the booster charge 58 is preferably utilized for the warhead 50 to reliably detonate.

The detonator 60 of the fuze 24 is disposed within the housing 52 being positioned between the firing pin 56 and the booster charge 58. The detonator 60 is disposed within a chamber 66 formed by the housing 52 of the fuze 24. The aperture 62 formed through the forward end 52A of the housing 52 opens into the detonator chamber 66. The detonator 60 is preferably cylindrical in shape and has a length substantially approaching that of the diameter of the chamber 64. The detonator 60 is further normally biased to a safe or unarmed condition set at a predetermined acute angle, for example 45 degrees, relative to the longitudinal extent of the firing pin 56, as shown in FIG. 6. The detonator 60 is movable from the unarmed condition to an armed condition, as seen in dashed line form in FIG. 6, in which the detonator 60 is in axial alignment with the firing pin 56 and the forward end 58B of the booster charge 58. The detonator 60 is moved to the armed condition upon or in response to acceleration of the munition assembly 14 and delivery or imposition of a set back force thereto created by firing of the propellant 48 and the resultant spinning or rotation of the cartridge 22 of the munition assembly 14. The detonator 60 is the most sensitive part of the system 10 and so the acceleration and set back force created by the propellant 48 and the resultant spinning caused by the rifling surface 30 are required before the detonator 60 will be placed in an armed condition in which it can explode upon impact with an object. These requirements ensure that the system 10 and munition assembly 14 are prevented from accidentally blowing up in the hands of the user. The detonator 60 will not respond to spinning unless the set back force first releases the detonator 60 from its predetermined non-aligned unarmed condition into its aligned armed condition with the firing pin 56 and the forward end 58B of the booster charge 58.

Figure 7:
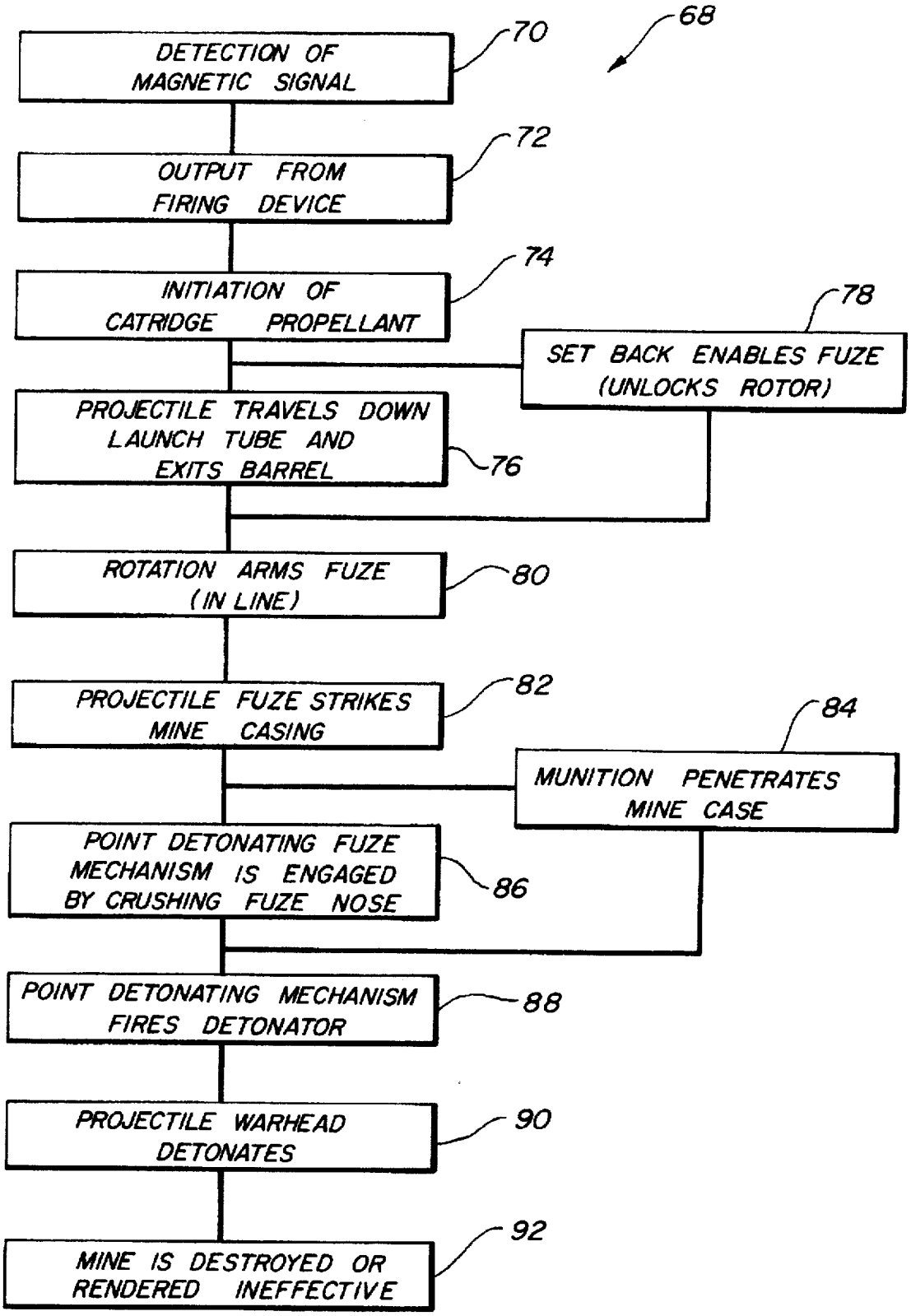
FIG. 7 is a flow chart of the steps involved in the operation of the system.

Referring now to FIG. 7, there is illustrated a flow chart, generally designated 68, showing a sequence of steps employed by underwater mine penetration system 10 of the present invention to achieve its intended objective, that being, to destroy an underwater mine from a safe distance. As represented by block 70 of the flow chart 68, the system 10 is made operational via detection of a magnetic or acoustic signal by the firing device 16 from a standoff source, or alternatively through use of a timer (not shown) to set off the system 10. The signal is decoded in a known manner by the firing device 16 with the subsequent output therefrom, as represented by block 72 of the flow chart 68, igniting the propellant 48 which provides a sufficient impulse to accelerate and send the munition assembly 14 down the launch tube 18 and out the forward open end 18A thereof, as represented by successive blocks 74, 76 of the flow chart 68. This acceleration of the munition assembly 14 creates the necessary set back force and spin to unlock and enable the detonator 60 from the unarmed condition to the armed condition, as represented by blocks 78, 80 of the flow chart 68, and also to impart sufficient energy to propel the munition assembly 14 from the standoff location and to strike the underwater mine (not shown) with enough velocity to penetrate a casing of the mine, as represented by blocks 82, 84 of the flow chart 68. Upon impact with the mine, as represented by blocks 86, 88 of the flow chart 68, the nose cone 54 is crushed rearward and the firing pin 56 in the nose cone 54 of the fuze 24 is thus forced to move in a rearward axial direction through the aperture 62 into the detonation chamber 66 so as to ram into the detonator 60 with sufficient energy to detonate and cause an explosion thereof. The explosion of the detonator 60 is then enhanced by the detonation and explosion of the booster charge 58 which forms a rearwardly travelling plane wave of exploding energy. The enhanced explosion of the booster charge 58 impacts and causes detonation of the explosive warhead 50, as represented by block 90 of the flow chart 68, which then provides an explosion sufficient to destroy or otherwise render ineffective the underwater mine, as represented by block 92 of the flow chart 68.

As examples, the warhead 50 per se can be an underwater explosive or some other similar high explosive. The fuze 24 per se can be a M505A3 PD fuze which is a stock item in the national small caliber munitions inventory. The fuze 24 requires three to six meters to arm at 3380 feet per second and 2030 revolutions per second when fired from a 20 mm gun. The fuze 24 generally has a diameter of 17 mm and a length of 31.2 mm making it ideal for small hand emplaced devices such as the present invention. The diameter of the projectile body 42 should be adequate to house a formidable high explosive or pyrophoric charge. The launch tube 18 per se can be a disposable version of a 20 mm or 30 mm gun barrel. A magnetic or acoustic form of the firing device 16 is generally used to safely, covertly and simultaneously operate one or more of the deployed systems 10 by a remote means. A simple timing mechanism can also be used to initiate the propellant 48 where a less expensive system 10 is desired. Other known methods for ignition of the munition assembly 14 could be utilized such as percussion primers, squibs, exploding bridge wires or an underwater timing fuse.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A hand emplaced underwater mine penetration system, comprising:

(a) a launching assembly including (i) a firing device adapted to activate upon receipt of a predetermined signal and (ii) a launch tube having a forward open end, a rear end opposite from said forward open end and connected to said firing device and a bore extending between said forward and rear ends; and (b) a munition assembly disposed at a rest position within said bore of said launch tube of said launching assembly adjacent to said firing device thereof for firing from said rest position in said bore of said launch tube, said munition assembly including (i) a cartridge having a projectile body formed by an outer annular wall and an inner transverse wall spaced from opposite ends of said outer annular wall and extending transversely across and attached to said outer annular wall, said outer annular wall and inner transverse wall together defining separate rear and forward cavities in said projectile body with said rear cavity being disposed adjacent to said firing device of said launching assembly and said forward cavity being spaced from said rear cavity and disposed remote from said firing device, (ii) said cartridge also having a propellant disposed within said rear cavity adjacent to said firing device and adapted to ignite upon activation of said firing device and an explosive warhead disposed within said forward cavity, said inner transverse wall being disposed between said rear and forward cavities and thus separating said propellant in said rear cavity from said explosive warhead in said forward cavity so that ignition of said propellant in said rear cavity, that fires said cartridge from said launch tube, is prevented from causing premature detonation of said explosive warhead in said forward cavity, and (iii) a fuze disposed adjacent and attached to a forward end of said cartridge and adapted to detonate and explode said explosive warhead in said forward cavity of said projectile body of said cartridge upon impact with an underwater mine after said firing of said cartridge from said bore of said launch tube, (iv) said fuse including a housing having a forward end and a rear end, and a nose cone connected to and extending forwardly from said forward end of said housing, said rear end of said housing being interfitted with said outer annular wall of said projectile body such that said rear end of said housing extends within said forward cavity of said projectile body, (v) said fuze further including a firing pin enclosed in said nose cone and mounted to said forward end of said housing, a booster charge located at said rear end of said housing and extending therewith in said forward cavity of said projectile body to said explosive warhead in said forward cavity of said projectile body, and a detonator disposed in said housing between said firing pin and booster such that said explosive warhead is exploded by detonation of said booster charge as a result of actuation of said detonator by impact from said firing pin.

2. The system of claim 1 wherein said launching assembly further includes a safety element removably connected to said firing device so as to prevent accidental set off of said firing device.

3. The system of claim 1 wherein said launch tube of said launching assembly is substantially cylindrical in shape and has an external containment tube and an internal rifling insert surface therein surrounding said bore of said launch tube.

4. The system of claim 1 wherein said launching assembly further includes means for anchoring said launch tube.

5. The system of claim 4 wherein said anchoring means includes:

an external pivotable shovel attached to the underside of said launch tube; and a pair of external alligator clasps attached to a side of said launch tube and extending thereabove.

6. The system of claim 1 wherein said outer annular wall of said projectile body of said cartridge of said munition assembly is substantially cylindrical in shape and said nose cone and forward end of said housing together have a forwardly tapered configuration smaller in cross-section than said cylindrical outer annular wall of said projectile body.

7. The system of claim 1 wherein said detonator of said fuze of said munition assembly is normally biased to an unarmed condition set at a predetermined acute angle relative to said firing pin.

8. The system of claim 7 wherein said detonator of said fuze of said munition assembly is movable from said unarmed condition to an armed condition in which said detonator is in alignment with said firing pin and a forward end of said booster charge upon acceleration of said munition assembly and delivery of a set back force thereto being created by firing of said propellant and the resultant spinning of said munition assembly.

9. A munition assembly for exploding upon impact with an underwater mine, comprising:

(a) a cartridge including (i) a projectile body formed by an outer annular wall and an inner transverse wall spaced from opposite ends of said outer annular wall and extending transversely across and attached to said outer annular wall, said outer annular wall and inner transverse wall together defining separate rear and forward cavities in said projectile body, (ii) a propellant disposed within said rear cavity of said projectile body and adapted to ignite upon activation of a firing device, (iii) an explosive warhead disposed within said forward cavity of said projectile body, said inner transverse wall being disposed between said rear and forward cavities in said projectile body and thus separating said propellant in said rear cavity from said explosive warhead in said forward cavity so that ignition of said propellant in said rear cavity is prevented from causing premature detonation of said explosive warhead in said forward cavity; and (b) a fuze disposed at and attached to a forward end of said cartridge and adapted to detonate and explode said explosive warhead in said forward cavity of said projectile body of said cartridge upon impact with an underwater mine, said fuse including (i) a housing having a rear end and a forward end, said rear end being interfitted with said outer annular wall of said projectile body such that said rear end of said housing extends within said forward cavity of said projectile body, (ii) a nose cone connected to and extending forwardly from said forward end of said housing, (iii) a firing pin enclosed in said nose cone and mounted to said forward end of said housing, (iv) a booster charge located at said rear end of said housing and extending therewith in said forward cavity of said projectile body to said explosive warhead in said forward cavity of said projectile body, and (v) a detonator disposed in said housing between said firing pin and said booster such that said explosive warhead is exploded by detonation of said booster charge as a result of actuation of said detonator by impact from said firing pin.

10. The assembly of claim 9 wherein said outer annular wall of said projectile body of said cartridge is substantially cylindrical in shape and said nose cone and forward end of said housing together have a forwardly tapered configuration smaller in cross-section than said cylindrical outer annular wall of said projectile body.

11. The assembly of claim 9 wherein said detonator of said fuze of said munition assembly is normally biased to an unarmed condition set at a predetermined acute angle relative to said firing pin.

12. The assembly of claim 11 wherein said detonator of said fuze is movable from said unarmed condition to an armed condition in which said detonator is in alignment with said firing pin and a forward end of said booster charge.

* * * * *